US010827885B2

(12) United States Patent
Said

(10) Patent No.: US 10,827,885 B2
(45) Date of Patent: Nov. 10, 2020

(54) ANGLED FLUSHABLE MOIST WIPE DISPENSER

(71) Applicant: Sameer Said, Brooklyn, NY (US)

(72) Inventor: Sameer Said, Brooklyn, NY (US)

( * ) Notice: Subject to any disclaimer, the term of this patent is extended or adjusted under 35 U.S.C. 154(b) by 0 days.

(21) Appl. No.: 16/186,070

(22) Filed: Nov. 9, 2018

(65) Prior Publication Data

US 2020/0093336 A1 Mar. 26, 2020

Related U.S. Application Data

(60) Provisional application No. 62/735,525, filed on Sep. 24, 2018.

(51) Int. Cl.

| | |
|---|---|
| ***A47K 10/42*** | (2006.01) |
| ***B65D 83/08*** | (2006.01) |
| *A47K 10/32* | (2006.01) |

(52) U.S. Cl.

CPC ..... *A47K 10/421* (2013.01); *B65D 83/0835* (2013.01); *A47K 2010/3266* (2013.01)

(58) Field of Classification Search

CPC ..... A47K 10/421; A47K 10/185; A47K 2010/3266; A47K 10/42; B65D 83/0835

USPC ..... 220/480; 206/494

See application file for complete search history.

(56) References Cited

U.S. PATENT DOCUMENTS 4,535,912 A * 8/1985 Bonk ..... A47K 10/185 206/409

6,827,309 B1 12/2004 Newman et al.

8,317,061 B2 * 11/2012 Vignot ..... A47K 10/42 221/45

2013/0153597 A1 6/2013 Hill et al.

2014/0305958 A1 10/2014 Hill et al.

2015/0368026 A1 12/2015 Yamada

2016/0278518 A1 * 9/2016 Good ..... A47F 5/01

FOREIGN PATENT DOCUMENTS

WO 2007-044156 A1 4/2007

OTHER PUBLICATIONS

Boude Wipes CFB-AC-JCEV. Listing [online]. Sterling Global Products [retrieved on Jul. 2, 2018]. Retrieved from the Internet: <URL: https://www.amazon.com/Boude-Wipes-CFB-AC-JCEV-Flushable-Dispenser/dp/B00WGRJZEM/ref=sr_1_3?ie=UTF8&qid=1540402864&sr=8-3&keywords=Boude+Wipes>.

* cited by examiner

*Primary Examiner* — King M Chu

(74) *Attorney, Agent, or Firm* — Law Offices of Leo Mikityanskiy, P.C.; Leonid Mikityanskiy

(57) ABSTRACT

A moist wipe dispenser having a wipes container having a lid with an orifice for dispensing the wipes; an angled bottom surface; an inner bottom surface sharing an edge with the angled bottom surface and extending proximately parallel to the orifice, wherein a stack of wipes rests on the inner bottom surface; and a mounting means for removably installing the wipes container at a surface, wherein the angled bottom surface and the mounting means securely position the orifice and the stack of wipes at a stack angle for a continuous, one-at-a-time dispensing of the wipes requiring only one hand of a user.

18 Claims, 3 Drawing Sheets

ANGLED FLUSHABLE MOIST WIPE DISPENSER

FIELD OF THE INVENTION

The invention relates generally to moist wipe dispensers and more particularly, to flushable moist wipe dispensers removably attached to convenient locations, allowing the continuous, one-at-a-time issuing of wipes requiring only a single hand.

BACKGROUND OF THE INVENTION

Conventional moist wipes may be disposable and/or flushable and may have many applications, such as for use in place of traditional toilet paper, cleaning of disabled or incontinent adults, diaper-changing of infants and small children, household cleaning, and other uses. Typically, moist wipe dispensers or containers may have a box shape with a hinged lid. A flap on the lid covers a dispensing orifice or aperture through which the wipes are pulled out.

Such containers or "tubs" typically dispense individual wipes that are stacked within the container in an "interleaving" configuration, wherein the each individual wipe is folded and "interleaved" with an adjacent wipe, to form a stack. When a single wipe is removed through an orifice in the container, a portion of the next single wipe "pops" up or protrudes out of the orifice, to take its place in a conveniently accessible position for the user to grasp, allowing an easy and reliable dispensing of each of the wipes in the stack. Such containers are usually placed on counters, floors, etc. Such locations sometimes may be hard to reach and may also result in cluttered rooms and unsanitary wipes.

Various types of wipe dispensers have been proposed. For example, a "hanging" wipe dispenser is known in the art, for hanging from toilet-tissue holders. However, such arrangements tend to "swing" during the pulling out of a wipe, thus making one-handed dispensing difficult and possibly causing multiple wipes to bunch and "pop" out, or causing the stack of wipes to fall back and not dispense properly at all. On the other hand, without fixed attachment on a wall or other easily accessible location, users may have the above-described problem of loose "tubs" being placed in inconvenient places, such as floors, resulting in unclean wipes and containers. Also, the leaving of the tubs in various random and inconvenient locations may cause the user to forget to, or not bother to, refill the containers.

WO 200744156 (2007) and US 2013/0153597 (2013) include wipe dispensers that may be mounted to a wall or otherwise rigidly fixed. However, such arrangements cannot be easily attached—nor can they be easily removed if, for example, the user wants to take the tub with him.

The present invention addresses the above-described problems, as well as providing an easily installed and removable moist wipes container designed to permit the continuous, one-at-a-time dispensing of wipes requiring only a single hand.

SUMMARY OF THE INVENTION

A moist wipe dispenser has a wipes container having a lid with an orifice for dispensing the wipes; an angled bottom surface; an inner bottom surface sharing an edge with the angled bottom surface and extending proximately parallel to the orifice, wherein a stack of wipes rests on the inner bottom surface; and a mounting means for removably installing the wipes container at a surface, wherein the angled bottom surface and the mounting means securely position the orifice and the stack of wipes at a stack angle for a continuous, one-at-a-time dispensing of the wipes requiring only one hand of a user.

In another aspect of the invention, the mounting means has a metal plate in the angled bottom surface, for removably engaging with an attracting magnet affixed to the surface. In yet another aspect of the invention, the mounting means has a flat member extending from the angled bottom surface, for removably engaging with a clasp member affixed to the surface.

It is embodied in a mode of the invention, that the wipes are flushable wipes.

In is further embodied in a mode of the invention, that the lid is hinged at its bottom to the wipes container, for a downwards opening.

BRIEF DESCRIPTION OF THE DRAWINGS

Below, the invention is explained in more detail with reference to exemplary drawings showing the following elements of the angled moist wipe dispenser of the present invention.

Other features and advantages of the present invention will become apparent from the following detailed description, taken in conjunction with the accompanying drawings which illustrate, by way of example, the principles of the invention.

DETAILED DESCRIPTION OF THE INVENTION

Figure 1:
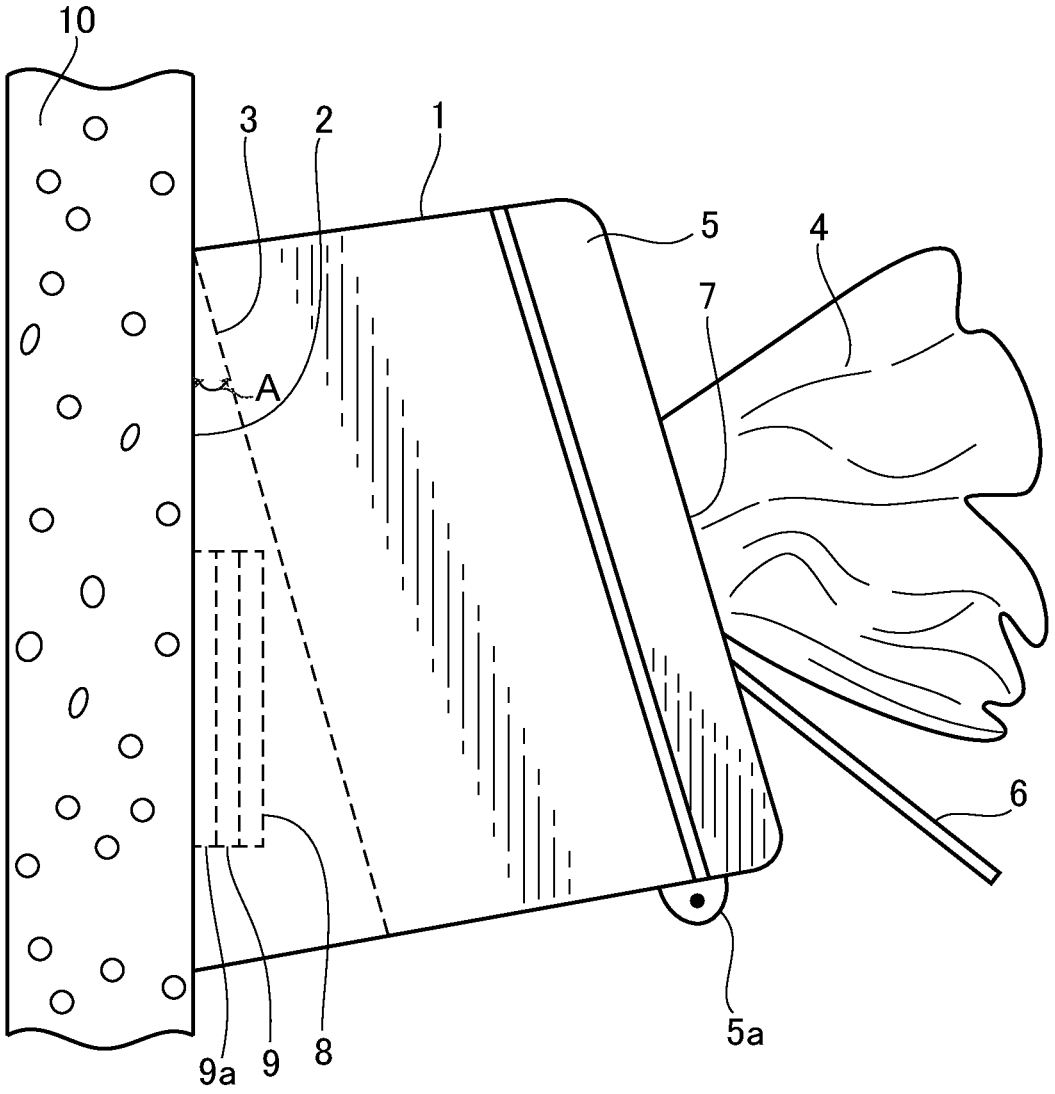
FIG. 1 shows a side elevational view of a moist wipe dispenser of the present invention.
Figure 2:
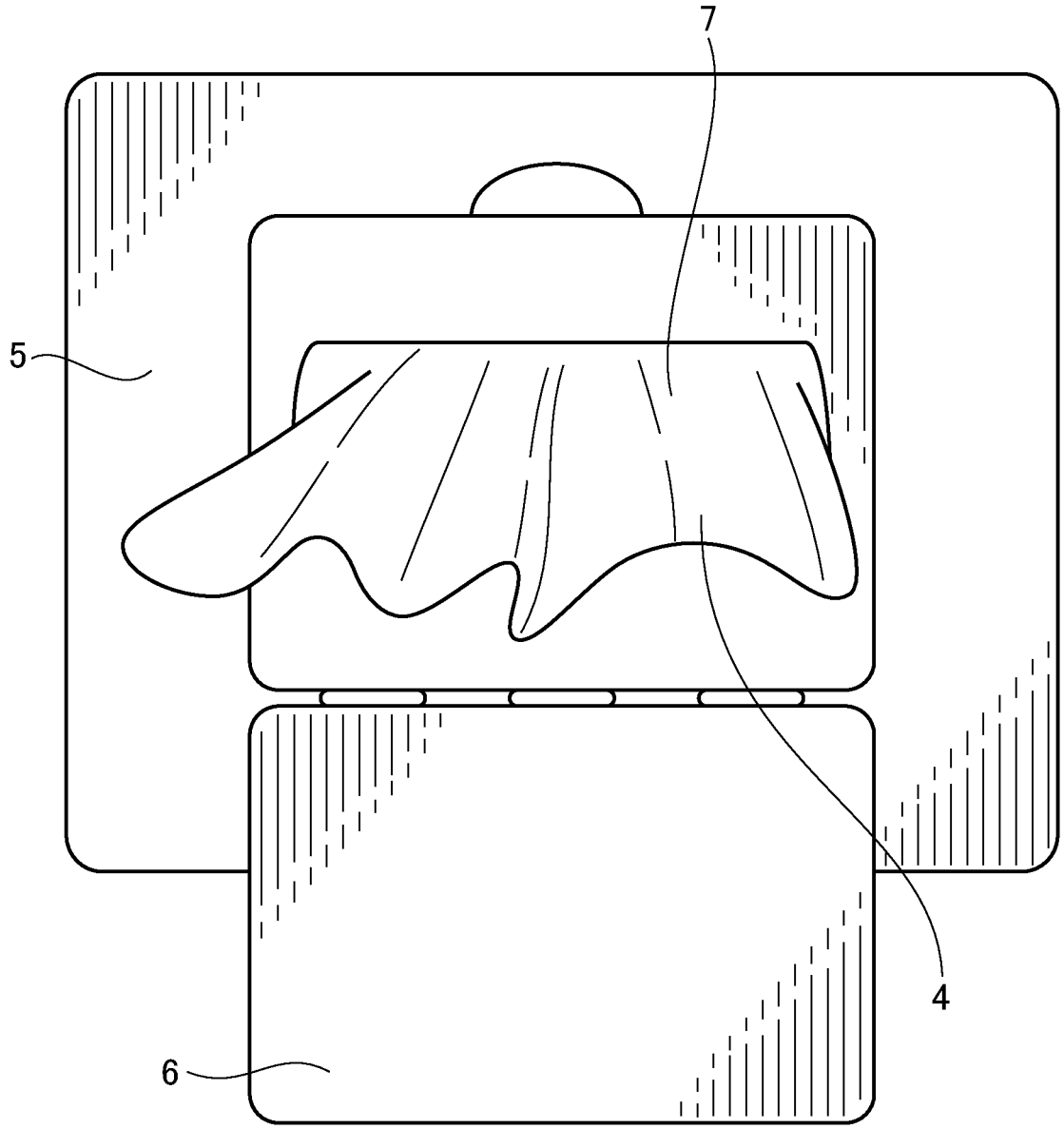
FIG. 2 shows a top plan view of the moist wipe dispenser.

As illustrated in FIGS. 1 and 2, the angled moist wipe dispenser 1 of the present invention has a rectangular box shape with a sloped or angled bottom 2. An inner "bottom" surface 3 maintains the rectangular box shape in the interior of the container, such that a stack of wipes 4 can rest on the inner bottom surface 3.

The wipes container has a lid 5, with a hinge 5*a* or other open/close means, and an open/close flap 6 on the lid covering an orifice 7 in the lid 5, through which a user pulls out the wipes 4. As described above, individual wipes are typically stacked within the container in an "interleaving" configuration. When a single wipe is removed through the orifice 7, a portion of the following, adjacent single wipe in the stack "pops" up or out of the orifice to take its place in a conveniently accessible position.

The sloped or angled bottom 2 has embedded therein a metal plate 8. A corresponding magnet 9 may be attached via a double-adhesive tape 9*a* or other means known in the art, to a wall 10 or other convenient surface.

Thus, the bottom 2 of the container easily and removably attaches or mounts to the wall 10, such as in a position near a toilet-tissue holder, or to any other desired and immediately accessible location, such as on a countertop, toilet tank or tabletop. The magnetic attachment is strong enough that a user can securely and continuously pull out individual wipes through the orifice 7 without moving or dislodging the container. When the dispenser is empty, the mounting means also permits the easy opening of the hinged lid 5 and the quick insertion of a refill stack of wipes.

On the other hand, the magnetic attachment means also permits the convenient and easy removal of the container from its location, as desired by the user, such as when moving it to a different room or for use during travel.

As mentioned above, the inner bottom surface 3 is approximately parallel to the lid 5, such that a stack of wipes can rest stably on the inner bottom surface 3 and the stack's top surface may remain approximately parallel to the lid 5 and the orifice 7, thereby maintaining the "interleaving" arrangement of the stack for optimal dispensing. As noted above, without such proper interleaving of the individual wipes, the wipes may bunch up or have other problems in dispensing, making the single-handed pulling out of wipes very difficult.

The specific angle A of the sloped bottom 2 relative to the inner bottom surface 3 may be arranged to optimize the slant of the dispenser 1 and its orifice 7 for the user to reach and pull out wipes. With the above-described configuration, the moist wipes dispenser of the present invention permits a continuous, single-handed, one-at-a-time dispensing of wipes. That is, the sloped or angled bottom 2 causes the stack of wipes to fall back during dispensing when a wipe is pulled out. Then, the user can pull out the protruding portion of the next wipe without pressure from the stack of remaining wipes, thereby maintaining the "interleaving" arrangement of the stack for optimal, easy, and reliable one-handed dispensing. In this way, due to the remaining stack falling back as described above, the user does not need to open the lid 5 and adjust the position of the stack and/or the "interleaving" configuration of the successive wipes. That is, the user does not need to open the lid 5 and/or adjust the wipes or the stack, in order to avoid the stack's applying pressure to the wipe currently being dispensed or otherwise hindering the dispensing, thereby maintaining the continuous, single-handed, one-at-a-time dispensing process.

Figure 3:
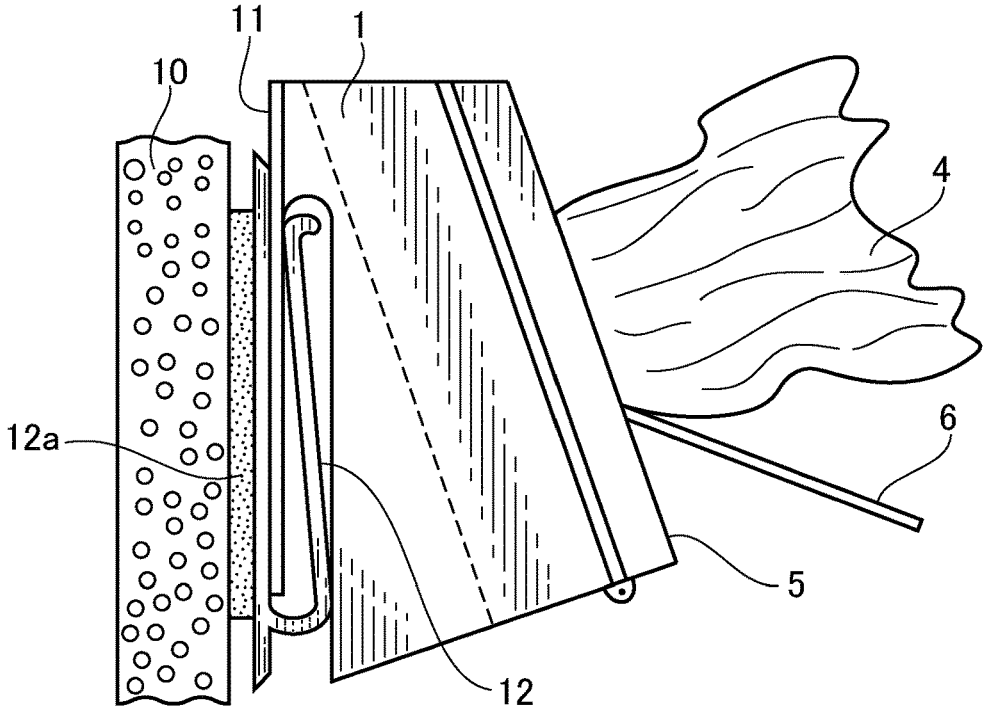
FIG. 3 shows a side elevational view of an exemplary variation of a mounting means.
Figure 4:
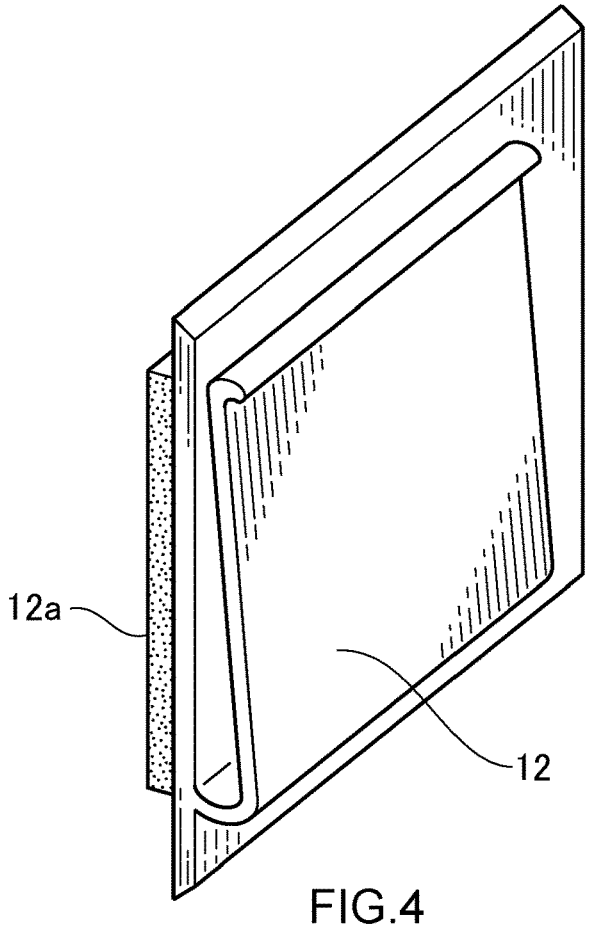
FIG. 4 shows a perspective view of the mounting means variation shown in FIG. 3.

FIGS. 3 and 4 illustrate a variation on the mounting means. Instead of a metal plate and a magnet, the variation uses a rectangular, thin and flat element 11 extending downwardly from a top edge of the sloped bottom 2. A corresponding, relatively wide hook or clasp 12, made of a plastic or other suitable material as commonly known, is attached to a wall or other desired surface with double-sided tape 12*a* or other means known in the art.

The flat element 11, when inserted downwardly into the clasp 12, engages and interlocks with the clasp 12 to securely mount the dispenser 1 to the desired surface. By applying a moderate amount of pressure to lift the dispenser 1 upwards, the element 11 can disengage from the clasp 12 for an easy removal of the wipe dispenser 1 to bring it to another location.

It is to be understood that the above-described embodiments are illustrative of only a few of the many possible specific embodiments which can represent applications of the principles of the invention. For example, it is to be understood that other variations on the mounting or affixing means in addition to the above-described embodiment and exemplary variation, as can be envisioned by those skilled in the art, may be adopted.

Numerous and varied other arrangements can be readily devised by those skilled in the art without departing from the spirit and scope of the invention.

What is claimed is:

1. A dispenser for dispensing moist wipes, comprising:

(a) a bottom having an inner bottom surface and an outer bottom surface substantially parallel to the inner bottom surface;

(b) at least four walls rising substantially vertically from the inner bottom surface and defining an internal space of the dispenser for placement of partially-connected, individually separable moist wipes interleaved in a stack, each of the at least four walls having an upper edge, said upper edges forming an opening of the dispenser;

(c) a lid fitted to the opening substantially parallel to the bottom, said lid having an aperture for dispensing wipes; and attachment means, comprising one of magnet and magnetic metal plate, cooperating magnets, reciprocating wide hooks, hook and loop attachment, wide hook and clasp, wide hook and latch, and double-sided adhesive tape, coupled with the outer bottom surface for removably attaching the dispenser to a substantially vertical surface so that the bottom and the lid are angled by the attachment means versus the substantially vertical surface, wherein the inner bottom surface is configured to stably support the stack at an angle versus the substantially vertical surface and the stack rests on the inner bottom surface without exerting force on the lid, thereby maintaining the partially-connected, individually separable moist wipes interleaved in the stack for optimal dispensing of the partially-connected, individually separable moist wipes.

2. The dispenser of claim 1, wherein the aperture is closed by a movable flap in the lid when the dispenser is not in use to prevent loss of moisture from the wipes.

3. The dispenser of claim 1, wherein an angle by which the bottom and the lid are angled versus the substantially vertical surface is optimized for the tilt of the dispenser and the aperture to enable a user to pull out the partially-connected, individually separable moist wipes without bunching and to avoid collapsing of the stack after a quantity of the partially-connected, individually separable moist wipes is removed from the dispenser.

4. The dispenser of claim 3, wherein the angle is in the range of 15-25 degrees.

5. The dispenser of claim 1, wherein the opening is rectangular.

6. The dispenser of claim 1, wherein the opening is substantially planar.

7. The dispenser of claim 1, wherein the lid is detachable.

8. The dispenser of claim 1, wherein the lid has a top edge with a snap closure and a bottom edge hinged to the upper edge of a lowermost one of the at least four walls when the dispenser is attached to the substantially vertical surface and wherein the lid pivots downwardly when the lid is open.

9. The dispenser of claim 1, wherein the attachment means comprises the magnetic metal plate coupled with the outer bottom surface for removably engaging with a magnet affixed to the substantially vertical surface.

10. The dispenser of claim 1, wherein the attachment means comprises a flat element extending from the outer bottom surface for removably engaging with a clasp affixed to the substantially vertical surface.

11. The dispenser of claim 1, wherein the attachment means are recessed into the bottom of the dispenser.

12. A dispenser for dispensing moist wipes, comprising:

(a) a wedge-shaped bottom having an inner bottom surface and an outer bottom surface non-parallel to the inner bottom surface, said inner bottom surface and outer bottom surface being connected at at least one edge;

attachment means, comprising one of magnet and magnetic metal plate, cooperating magnets, reciprocating wide hooks, hook and loop attachment, wide hook and clasp, wide hook and latch, and double-sided adhesive tape, coupled with the outer bottom surface for removably attaching the dispenser to a substantially vertical surface;

(c) at least four walls, each having an upper edge and a lower edge and two substantially vertical side edges between the upper edge and the lower edge, wherein the at least four walls are connected to the inner bottom surface at each respective lower edge and each of the at least four walls is connected to two adjacent walls of the at least four walls at the substantially vertical side edges, the at least four walls defining an internal space of the dispenser capable of receiving partially-connected, individually separable moist wipes interleaved in a stack and forming an opening of the dispenser defined by the upper edge of each of the at least four walls; and (d) a lid securely fitted to the opening, said lid having an aperture for dispensing wipes and a flap for selectively opening and closing the aperture, wherein the opening and the lid are substantially parallel to the inner bottom surface and wherein the inner bottom surface is configured to stably support the stack at an angle versus the substantially vertical surface, thereby maintaining the stack for optimal dispensing of the partially-connected, individually separable moist wipes.

13. The dispenser of claim 12, wherein an angle by which the inner bottom surface, the opening, and the lid are angled versus the substantially vertical surface is optimized for the tilt of the dispenser and the aperture to enable a user to pull out the partially-connected, individually separable moist wipes without bunching and to avoid collapsing of the stack after a quantity of the partially-connected, individually separable moist wipes is removed from the dispenser.

14. The dispenser of claim 12, wherein the opening is rectangular.

15. The dispenser of claim 12, wherein the lid is detachable.

16. The dispenser of claim 12, wherein the lid has a top edge with a snap closure and a bottom edge hinged to the upper edge of a lowermost one of the at least four walls when the dispenser is attached to the substantially vertical surface and wherein the lid pivots downwardly when the lid is open.

17. The dispenser of claim 1, wherein the attachment means comprises a flat element extending from the outer bottom surface for removably engaging with a clasp affixed to the substantially vertical surface.

18. The dispenser of claim 12, wherein the attachment means are recessed into the outer bottom surface.

* * * * *